US006123342A

United States Patent [19]

Grell

[11] Patent Number: 6,123,342

[45] Date of Patent: Sep. 26, 2000

[54] HIGH BACK BINDING FOR BOARD ATHLETIC EQUIPMENT

[76] Inventor: Jeffrey L. Grell, 9500 Ventura Way, Chatsworth, Calif. 91331

[21] Appl. No.: 09/088,666

[22] Filed: Jun. 2, 1998

[51] Int. Cl.[7] ..... A43B 7/20

[52] U.S. Cl. ..... 280/11.36; 36/117.1; 280/14.2

[58] Field of Search ..... 280/11.36, 14.2, 280/618; 36/115, 117.1, 109

[56] References Cited

U.S. PATENT DOCUMENTS

| | | | |
|---|---|---|---|
| 5,690,350 | 11/1997 | Turner et al. | 280/613 |
| 5,761,835 | 6/1998 | Okajima | 36/115 X |
| 5,771,609 | 6/1998 | Messmer | 36/115 X |
| 5,819,440 | 10/1998 | Okajima | 36/115 X |
| 5,901,469 | 5/1999 | Saillet | 36/115 X |

*Primary Examiner*—Michael Mar
*Attorney, Agent, or Firm*—Robert J. Schaap

[57] ABSTRACT

A binding for use on snow skis and snowboards arranged to receive a boot of a user, as well as attachments for existing boot bindings. The invention is primarily effective as a high back snowboard binding. A forwardly extending leg bearing support plate or tab is located on one or both of the boot bindings and on the exterior face of that binding so that a user may lean into both the back of these binding and laterally against the forwardly extending leg bearing support plate in order to aid in maneuvering the binding and, hence, the snowboard or ski. The support plate is located at the upper portion of the back and extends around the side and forwardly of the leg of the user and slightly above the ankle portion of the user so that a user may literally engage and push the lower portion of the user's leg immediately above the ankle against this lateral support plate for maneuvering the snowboard or ski.

23 Claims, 1 Drawing Sheet

HIGH BACK BINDING FOR BOARD ATHLETIC EQUIPMENT

BACKGROUND OF THE INVENTION

1. Field of the Invention

This invention relates in general to certain new and useful improvements in bindings for board athletic equipment and, more particularly, to bindings for snow skis and snowboards which enable improved maneuvering of the snowboards and skis.

2. Brief Description of Related Art

The sport of snow skiing has existed for many years and has resulted, not only in improvements in the skis, but in the bindings used in those skis for locking to the boots of the user. More recently, snowboarding has also become a popular sport and, in this case, a binding is secured to the snowboard so that a user may slip his or her boot into the binding for locking to the snowboard.

In the case of snowboards, potentially due to the relative infancy of this sport, little attention has been paid to improving the binding or, for that matter, improving the ability to maneuver the snowboard. Maneuvering of a snow ski and, for that matter, a snowboard, usually is accomplished by a shifting of the weight of the user and his or her position on the snowboard or ski in order effectuate a turning movement. In effect, the snowboard and the ski are essentially controlled by a series of turns. Consequently, it is important for a user to be able to cause a maneuvering of the snow board or ski rapidly and in response to quick changes of body position and weight by the user.

In a ski binding, the ski boot of the user is tightly bound to the ski and, hence, any movement of the user is quickly reflected in the ski or snowboard. However, in the case of snowboards, there is a need for the snowboard user to exert some force either against the rear of the binding or against the side of that snowboard in order to impart that force necessary to achieve certain turning movements. However, in the past, little attention has been given to the improvement of snowboard bindings which would enable a user to apply a sidewards or lateral force to the edge of the snowboard in order to achieve a desired movement. As a result, in order to properly maneuver a snowboard, the user had to exercise a substantial degree of skill or otherwise use a substantial amount of force to cause a maneuvering of the snowboard. However, heretofore, snowboard bindings have only been designed to hold an athletic boot to the ski or snowboard. They have not been designed to provide an aid or assist to a user in making a turn or otherwise stopping the snowboard.

OBJECTS OF THE INVENTION

It is, therefore, one of the primary objects of the present invention to provide a binding for athletic board equipment, such as snow skis and snowboards, and which will aid in maneuvering of the snow equipment.

It is another object of the present invention to provide an improved binding of the type stated which highly effective for use on snowboards and snow skis and is capable of tightly securing the boot of a suer to the snow equipment, as well as in enabling the user to guide the equipment.

It is a further object of the present invention to provide a binding of the type stated which is effective in enabling a user of the binding to exert a force on the side of the board to cause a turning movement thereof.

It is an additional object of the present invention to provide an attachment for existing board equipment bindings which aid a user of the binding to cause a turning force to the equipment.

It is also an object of the present invention to provide a binding of the type stated which can be manufactured at a relatively low cost and which is effective with a variety of differently sized snow equipment.

It is another salient object of the present invention to provide a method of imparting a turning movement to a snowboard or snow ski through a lateral support plate secured to a binding on the ski or snowboard.

With the above and other objects in view, my invention resides in the novel features of form, construction, arrangement and combination of parts presently described and pointed out in the claims.

SUMMARY OF THE INVENTION

The invention relates primarily to an athletic boot binding for attachment to athletic equipment and, particularly, athletic equipment used in snow. The athletic boot binding in a preferred embodiment adopts the form of a ski boot binding or otherwise a snowboard binding.

The binding is designed to provide ankle support and femur support when a user leans either backwardly or laterally or both. In this way, and although most snowboard boot bindings are designed to allow for a backward force, the binding of the present invention also allows for the application of a lateral force and which enables improved maneuvering of the ski or snowboard.

The binding of the present invention, in a preferred embodiment, comprises a sole plate provided for disposition on the athletic equipment. A partially encircling relatively rigid boot frame extends upwardly from the sole plate and engages a portion of a user's leg. Typically, this boot frame extends upwardly above the tarsus and to the region of the fibula.

A back plate is located at the rear portion of the binding and extends upwardly along the back of user's leg and above the tarsus. Typically, the back plate extends upwardly from the tarsus for a substantial distance at least sufficient to enable an user to apply a rearwardly directed force to the back plate. This enables a maneuvering of the athletic equipment. Generally, the back plate extends upwardly to a height not quite reaching that of the tibia.

A lateral support plate is located at the upper end of the back plate and extends forwardly of the back plate and is located to engage and provide a support against a user's lower leg, typically in the region of the fibula or the tibia. This lateral support plate provides a support to the user's lower leg and ankle when a user leans laterally to one side of a boot in the binding thereby providing a lateral force to athletic equipment.

The boot binding of the present invention comprises a relatively rigid frame and is adapted for rigid securement to the sole plate. In addition, the lateral support plate is secured to the frame and extends forwardly of and along a lateral side of the user's leg. This support plate is sufficient rigid laterally so that it does not yield substantially in a lateral direction. This allows a lateral force from the user's leg to be applied to the athletic equipment.

In a more preferred embodiment, the support plate may be integral with the foot frame. However, in many cases, the support plate may be provided as an accessory item which can be secured to the foot frame by means of conventional fasteners. In still a further embodiment, a pair of these lateral support plates may be provided with one on each side of the binding.

This invention possesses many other advantages and has other purposes which may be made more clearly apparent from a consideration of the forms in which it may be embodied. These forms are shown in the drawings forming a part of and accompanying the present specification. They will now be described in detail as set forth in the following detailed description, for purposes of illustrating the general principles of the invention. However, it is to be understood that this detailed description and the accompanying drawings are not to be taken in a limiting sense.

BRIEF DESCRIPTION OF THE DRAWINGS

Figure 1:
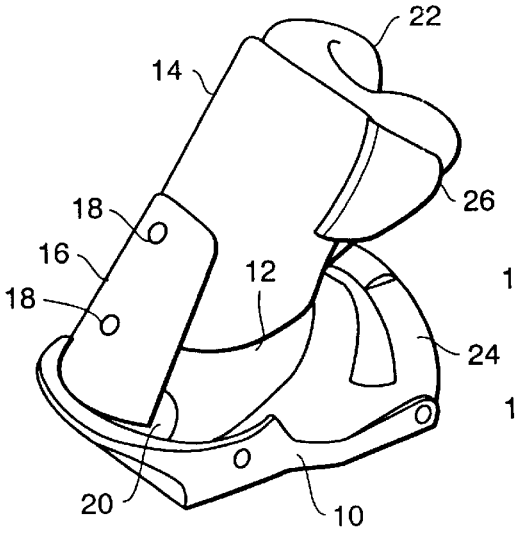
Figure 2:
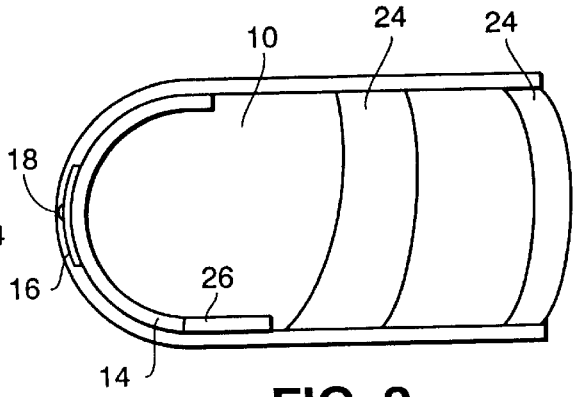
Figure 3:
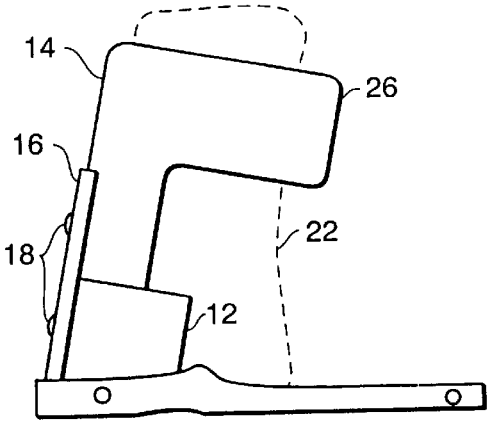
Figure 4:
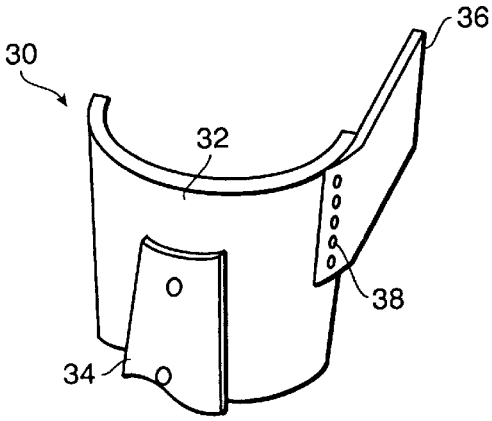
Figure 5:
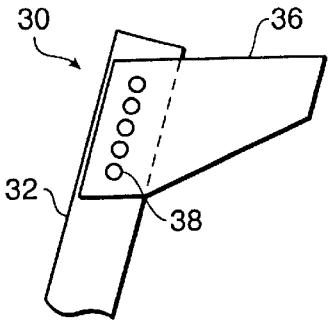
Figure 6:
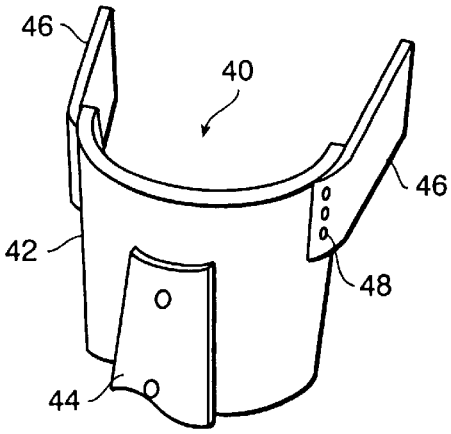

Having thus described the invention in general terms, reference will be made to the accompanying drawings in which:

FIG. 1 is a perspective view of an athletic boot binding constructed in accordance with and embodying the present invention;

FIG. 2 is a top plan view of the boot binding of FIG. 1;

FIG. 3 is a side elevational view of the boot binding of FIG. 1;

FIG. 4 is a fragmentary rear elevational view of a modified form of boot binding and showing a lateral support plate secured to the binding by conventional fasteners;

FIG. 5 is a fragmentary side elevational view showing the embodiment of the boot binding of FIG. 4; and FIG. 6 is a fragmentary perspective view showing still a further modified form of binding with a pair of laterally extending support plates.

DETAILED DESCRIPTION OF A PREFERRED EMBODIMENT

Referring now in more detail and by reference characters to the drawings, which illustrate a preferred embodiment of the present invention, A designates a boot binding comprising a sole plate 10 which is adapted for attachment to athletic equipment. In the embodiment as shown, and as described herein, the boot binding will be that adapted for attachment to a snowboard. However, it should be understood that the boot binding could be adapted for attachment to other forms of athletic equipment with slight modification thereto. In this respect, the boot binding would be effective for use on skateboards and like devices for receiving a conventional boot of a user.

The sole plate 10 is preferably provided with means for attachment to the athletic equipment. This means for attachment could be in the form of screw holes or the like for receiving conventional fasteners, such as screws or pins, which would otherwise secure to the snowboard or other athletic equipment. The exact means for mounting the sole plate to the equipment is conventional and is therefore neither illustrated nor described in any further detail herein.

The boot binding generally comprises an upwardly extending ankle plate 12 which extends about the rear portion of the sole plate 10 and on the lateral sides in the regions of the user's ankle. Extending upwardly from the sole plate and being somewhat hingedly connected thereto is a relatively rigid back plate 14 in the manner as illustrated in FIG. 1. The back plate 14 in the embodiment as illustrated is a so-called "high-back" binding and typically referred to in the industry as a "hi-back" binding.

Also extending upwardly from the sole plate at the rear portion of the binding is a relatively rigid reinforcing rib 16. This reinforcing rib is secured both to the ankle plate and the rigid back plate 14 by means of rivets or like fasteners 18. It can be observed that the boot binding has a removed section 20 at the very rear portion thereof to receive the heel of a user's boot.

The boot binding of the invention may be provided with a fabric liner 22 of the type shown in dotted lines in FIG. 1. This liner is frequently made of a leather or similar material and would effectively form a boot so that a user could literally insert a foot with a sock thereon directly into the boot. In a more preferred embodiment, the binding is not provided with a boot, but is adapted to receive a conventional boot of a user. For this purpose, the binding is provided with cross-straps 24 on the sole plate and which are adapted to engage the upper surface of the boot and releasably hold the boot onto the binding.

In accordance with the present invention, a lateral support plate 26 is secured to the back plate 14 and extends forwardly thereof on a lateral side of the binding. Typically, the support plate extends on the outer side of the boot, that is, the side where a user would lean and apply a lateral force in order to maneuver the snowboard or other athletic equipment.

The lateral support plate 26 is integral with the binding in the manner as shown in FIG. 1. Moreover, it is located at the very upper portion of the back plate 14, as shown, and extends forwardly of the back plate at least for the distance that a user might lean forward in the binding so as to enable the leg of the user to engage the support plate when the user applies a lateral force, regardless of the forward or rearward position of the leg.

Typically, the lateral support plate is in the region of either the fibula or the tibia. Generally, it remains in the region of the fibula but could be as high as the region of the tibia. In all cases, it is located below the patella of the user's leg.

FIG. 5 illustrates a modified form of boot binding in accordance with the present invention. In this embodiment, a conventional high back boot binding 30 is illustrated and includes a rigid back plate 32 with a rear support rib 34, as shown. In this embodiment, a lateral support plate 36, essentially equivalent to the support plate 26, is secured to one side of the back plate 32 by means of conventional fasteners 38, such as rivets or the like. In this way, a lateral support plate can be secured to a conventionally existing boot binding.

FIG. 6 illustrates another modified form of boot binding 40 constructed in accordance with and embodying the present invention. This boot binding 40 is similar to the boot binding 30 and comprises a high back plate 42 secured with a rigid support rib 44 at the rear portion thereof. Secured to each of the lateral sides of the back plate 42 are a pair of lateral support plates 46 in the embodiment as illustrated. Here again, the support plates are secured by means of rivets 48 or other conventional fasteners.

It should also be understood in connection with the present invention that a boot binding similar to that shown in FIG. 6 could be constructed where the lateral support plates 46 are actually integral with the binding. In either case, it is important for the lateral support plate 46 to remain relatively rigid when a user applies a lateral force to the binding and to effectively resist that lateral force so that any force will be transmitted to the athletic equipment.

It should be recognized that the back plate could be symmetrically designed so as to provide a relatively wide back support area. The term "athletic board equipment" as used herein typically refers to equipment containing a board which normally receives the feet of the user as, for example, a snowboard or ski or, for that matter, a skateboard. The binding of the invention is essentially effective on all types of board equipment.

Thus, there has been illustrated and described a unique and novel binding having a lateral support plate thereon and which thereby fulfills all of the objects and advantages which have been sought therefor. It should be understood that many changes, modifications, variations and other uses and applications which do not depart from the spirit and scope of the invention will be become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what we desire to claim and secure by Letters Patent is:

1. An athletic boot binding for attachment to athletic board equipment and which provides ankle and femur support when a user leans, either backwardly or laterally or both, to apply a lateral force to the athletic equipment during athletic maneuvers, said boot comprising:

a) a sole plate provided for disposition on the athletic equipment;

b) a partially encircling relatively rigid boot frame extending upwardly from said sole plate and engaging a portion of a user's leg;

c) a relatively rigid back plate secured to a rear portion of said relatively rigid boot frame and extending upwardly above the relatively rigid boot frame along the back of a user's leg above the ankle of the user for a substantial distance at least sufficient to enable a user to apply a rearwardly directed force to the back plate to thereby enable a maneuvering of the athletic equipment; and d) a relatively rigid lateral support plate extending forwardly of said back plate and extending along a lateral side of a user's leg and located to engage and provide a support against a user's lower leg and ankle when a user's leg is canted forwardly in said binding and the user leans laterally to one side of a boot in said binding regardless of the angle of the leg cant in said binding for providing a lateral force to the athletic equipment, said support plate being sufficiently laterally rigid so as not to yield substantially in a lateral direction allowing a lateral force from the user's leg to be directly applied to the athletic board equipment.

2. The athletic boot binding of claim 1 further characterized in that said rigid boot frame is rigidly secured to said sole plate.

3. The athletic boot binding of claim 2 further characterized in that said relatively rigid lateral support plate and said back plate are secured in such manner that they are canted forwardly on and at an acute angle with respect to said sole plate.

4. The athletic boot binding of claim 2 further characterized in that said lateral support plate is integral with said rigid back plate.

5. The athletic boot binding of claim 3 further characterized in that said lateral support plate is secured by fasteners to said relatively rigid back plate.

6. An athletic boot binding for attachment to athletic board equipment and which provides ankle and femur support when a user learns laterally to apply a lateral force to the athletic equipment during athletic maneuvers, said boot comprising:

a) a sole plate provided for disposition on the athletic equipment;

b) an upstanding heel section extending upwardly from said sole plate;

c) an ankle plate extending from said heel section and around a portion of the ankle of the user's foot;

d) a back plate secured to said sole plate or said ankle plate at a rear portion of said binding and extending upwardly along the back of a user's leg above the ankle plate for a distance sufficient to enable a user to apply a rearwardly directed force to the back plate to enable a maneuvering of the athletic equipment; and e) a relatively rigid lateral support plate on said back plate and extending forwardly of said back plate along a lateral side of a user's leg and above said ankle plate to engage and provide a support against a user's lower leg and ankle when the user's leg is canted forwardly in said binding and the user leans laterally to one side of a boot in that binding regardless of the angle of the leg cant in said binding for providing a lateral force to the athletic equipment, said support plate being sufficiently laterally rigid so as not to yield substantially in a lateral direction thereby permitting a lateral force from the user's leg to be directly applied to the athletic board equipment.

7. The athletic boot binding of claim 6 further characterized in that said heel section and said ankle plate are secured to said sole plate.

8. The athletic boot binding of claim 7 further characterized in that said relatively rigid lateral support plate, and said back plate are secured in such manner that they are canted forwardly on and at an acute angle with respect to said sole plate.

9. The athletic boot binding of claim 7 further characterized in that said support plate is integral with said back plate.

10. The athletic boot binding of claim 7 further characterized in that said support plate is secured by fasteners to said back plate.

11. A high back boot binding for attachment to athletic board equipment which allows for ankle and femur support when a user leans laterally to apply a lateral force to the athletic equipment during athletic maneuvers and where the binding comprises a sole plate and a back plate which extends upwardly from the sole plate at the rear portion thereof and which also is sufficient to enable a user to apply a rearwardly directed force to the back plate to enable maneuvering of the athletic equipment, the improvement comprising:

a relatively rigid lateral support plate secured to said sole plate or back plate and extending forwardly of said back plate and extending along a lateral side of a user's leg, said support plate extending forwardly of a user's leg sufficiently so that a user may be canted forwardly in the boot binding and located to engage and provide a support against a user's lower leg and ankle when a user leans laterally to one side of a boot in said binding regardless of the angle of the leg cant in said binding to thereby provide a lateral force to the athletic equipment, said support plate being sufficiently laterally rigid so as not to yield substantially in a lateral direction thereby permitting a lateral force from the user's leg to be directly applied to the athletic board equipment.

12. The high back boot binding of claim 11 further characterized in that said relatively rigid lateral support plate is secured to said back plate and extends forwardly of and at least along a lateral side of a user's leg and said back plate are secured in such manner that they are canted forwardly on and at an acute angle with respect to said sole plate.

13. The high back boot binding of claim 11 further characterized in that said support plate is integral with said back plate.

14. The high back boot binding of claim 11 further characterized in that said support plate is secured by fasteners to said back plate.

15. An athletic boot binding for attachment to athletic board equipment and which provides ankle and femur support when a user leans, either backwardly or laterally or both, to apply a lateral force to the athletic equipment during athletic maneuvers, said boot comprising:

a) a sole plate provided for disposition on the athletic equipment;

b) a partially encircling relatively rigid boot frame extending upwardly from said sole plate and engaging a portion of a user's leg;

c) a relatively rigid back plate secured to a rear portion of said relatively rigid boot frame and extending upwardly above the relatively rigid boot frame along the back of a user's leg above the ankle of the user for a substantial distance at least sufficient to enable a user to apply a rearwardly directed force to the back plate to thereby enable a maneuvering of the athletic equipment;

d) a relatively rigid lateral support plate extending forwardly of said back plate and extending along a lateral side of a user's leg and located to engage and provide a support against a user's lower leg and ankle when a user leans laterally to one side of a boot in said binding regardless of the angle of the leg cant in said binding for providing a lateral force to the athletic equipment, said support plate being sufficiently laterally rigid so as not to yield substantially in a lateral direction allowing a lateral force from the user's leg to be directly applied to the athletic board equipment; and e) reinforcing rib extending upwardly from a rear portion of the sole plate and secured to the rigid boot frame and the rigid back plate.

16. The athletic boot binding of claim 15 further characterized in that said rigid boot frame is rigidly secured to said sole plate.

17. The athletic boot binding of claim 15 further characterized in that said relatively rigid lateral support plate and said back plate are secured in such manner that they are canted forwardly on and at an acute angle with respect to said sole plate.

18. The athletic boot binding of claim 15 further characterized in that said lateral support plate is integral with said rigid back plate.

19. The athletic boot binding of claim 16 further characterized in that said lateral support plate is secured by fasteners to said relatively rigid back plate.

20. An improvement in a high back boot binding for attachment to athletic board equipment which allows for ankle and femur support when a user leans laterally to apply a lateral force to the athletic equipment during athletic maneuvers and where the binding comprises a sole plate and a back plate which extends upwardly from the sole plate at the rear portion thereof and which also is sufficient to enable a user to apply a rearwardly directed force to the back plate to enable maneuvering of the athletic equipment, the improvement comprising:

a) a relatively rigid lateral support plate secured to said sole plate or back plate and extending forwardly of said back plate, said support plate extending forwardly of a user's leg sufficiently so that a user may be canted forwardly in the boot binding and extending along a lateral side of a user's leg located to engage and provide a support against a user's lower leg and ankle when a user leans laterally to one side of a boot in said binding to thereby provide a lateral force to the athletic equipment, said support plate being sufficiently laterally rigid so as not to yield substantially in a lateral direction thereby permitting a lateral force from the user's leg to be directly applied to the athletic board equipment; and b) a reinforcing rib extending upwardly from a rear portion of said sole plate and secured to the relatively rigid boot frame and relatively rigid back plate.

21. The improvement to a high back boot binding of claim 20 further characterized in that said relatively rigid lateral support plate is secured to said back plate and extends forwardly of and at least along a lateral side of a user's leg and said back plate are secured in such manner that they are canted forwardly on and at an acute angle with respect to said sole plate.

22. The athletic boot binding of claim 20 further characterized in that said support plate is integral with said back plate.

23. The athletic boot binding of claim 20 further characterized in that said support plate is secured by fasteners to said back plate.

* * * * *